US009360286B2

(12) United States Patent
Pettersson et al.

(10) Patent No.: US 9,360,286 B2
(45) Date of Patent: Jun. 7, 2016

(54) ROTATIONALLY STABILIZED GUIDABLE PROJECTILE AND METHOD FOR GUIDING THE SAME

(75) Inventors: Thomas Pettersson, Karlskoga (SE); Daniel Brohede, Karlstad (SE)

(73) Assignee: BAE Systems Bofors AB, Karlskoga (SE)

( * ) Notice: Subject to any disclaimer, the term of this patent is extended or adjusted under 35 U.S.C. 154(b) by 160 days.

(21) Appl. No.: 14/130,635

(22) PCT Filed: Jun. 26, 2012

(86) PCT No.: PCT/SE2012/000098

§ 371 (c)(1),
(2), (4) Date: Mar. 14, 2014

(87) PCT Pub. No.: WO2013/006106

PCT Pub. Date: Jan. 10, 2013

(65) Prior Publication Data

US 2014/0209732 A1 Jul. 31, 2014

(30) Foreign Application Priority Data

Jul. 7, 2011 (SE) ..... 1130064

(51) Int. Cl.

| | |
|---|---|
| ***F42B 10/06*** | (2006.01) |
| ***F42B 10/26*** | (2006.01) |
| ***F42B 10/14*** | (2006.01) |
| ***F42B 10/54*** | (2006.01) |
| ***F42B 10/64*** | (2006.01) |

(52) U.S. Cl.

CPC ..... *F42B 10/26* (2013.01); *F42B 10/14* (2013.01); *F42B 10/54* (2013.01); *F42B 10/64* (2013.01)

(58) Field of Classification Search

None

See application file for complete search history.

(56) References Cited

U.S. PATENT DOCUMENTS

| | | | | | |
|---|---|---|---|---|---|
| 2,955,777 | A | * | 10/1960 | Null et al. | 244/3.14 |
| 3,392,934 | A | * | 7/1968 | Daniels | 244/3.23 |
| 3,610,096 | A | * | 10/1971 | Bauman et al. | 89/1.808 |
| 3,708,139 | A | * | 1/1973 | Wheeler | 244/3.13 |
| 3,976,266 | A | * | 8/1976 | Fieuzal et al. | 244/3.21 |
| 4,054,254 | A | * | 10/1977 | Cole | 244/3.21 |

(Continued)

FOREIGN PATENT DOCUMENTS

| | | | |
|---|---|---|---|
| DE | 3515326 | A1 | 10/1986 |
| EP | 1299688 | A1 | 4/2003 |

(Continued)

OTHER PUBLICATIONS

Supplementary European Search Report issued Nov. 18, 2014 in EP Appln. No. 12807239.

*Primary Examiner* — Medhat Badawi

(74) *Attorney, Agent, or Firm* — Polsinelli PC

(57) ABSTRACT

The invention relates to a rotationally stabilized projectile (1) for launching from a barrel, which projectile (1) comprises a front projectile part (22), a rear projectile part (20) comprising a rotating band (4), and an intermediate projectile part (21) comprising a freely rotatable middle section (2) arranged with guide wings (3) for improving the gliding capability and guidance capability during the gliding phase and end phase of the projectile. The guide wings (3) are arranged extensibly on the freely rotatable middle section (2), and the intermediate projectile part (21) also comprises a regulator device (14) for regulating the rotation of the middle section (2). The invention also relates to a method for guiding a rotationally stabilized projectile.

20 Claims, 1 Drawing Sheet

(56) References Cited

U.S. PATENT DOCUMENTS

| | | | | |
|---|---|---|---|---|
| 4,076,187 | A * | 2/1978 | Metz | 244/3.23 |
| 4,903,917 | A * | 2/1990 | Peller et al. | 244/3.21 |
| 4,964,593 | A * | 10/1990 | Kranz | 244/3.24 |
| 5,181,675 | A * | 1/1993 | Lardellier et al. | 244/54 |
| 5,322,243 | A * | 6/1994 | Stoy | 244/45 A |
| 5,379,968 | A * | 1/1995 | Grosso | 244/3.21 |
| 5,393,011 | A * | 2/1995 | Dunn et al. | 244/3.21 |
| 5,393,012 | A * | 2/1995 | Dunn | 244/3.23 |
| 5,417,393 | A * | 5/1995 | Klestadt | 244/3.27 |
| 5,423,497 | A * | 6/1995 | Ransom | 244/3.22 |
| 5,452,864 | A * | 9/1995 | Alford et al. | 244/3.23 |
| 5,476,045 | A * | 12/1995 | Chung et al. | 102/529 |
| 6,186,442 | B1 * | 2/2001 | Bittle | 244/3.29 |
| 6,435,097 | B1 * | 8/2002 | Garner et al. | 102/490 |
| 6,557,798 | B1 * | 5/2003 | Giesenberg et al. | 244/3.29 |
| 6,644,358 | B2 * | 11/2003 | Demarest et al. | 138/177 |
| 6,644,587 | B2 * | 11/2003 | Kusic | 244/3.24 |
| 6,672,537 | B1 * | 1/2004 | Deckard et al. | 244/3.29 |
| 6,832,740 | B1 * | 12/2004 | Ransom | 244/3.13 |
| 6,869,044 | B2 * | 3/2005 | Geswender et al. | 244/3.29 |
| 7,097,132 | B2 * | 8/2006 | Banks et al. | 244/3.29 |
| 7,105,790 | B2 * | 9/2006 | Lamorlette | 244/3.2 |
| 7,526,988 | B2 * | 5/2009 | Elder | 89/8 |
| 7,849,800 | B2 * | 12/2010 | Hinsdale et al. | 102/501 |
| 8,026,465 | B1 * | 9/2011 | Fraysse, Jr. | 244/3.22 |
| 8,097,838 | B2 * | 1/2012 | Ronn et al. | 244/3.27 |
| 8,816,261 | B1 * | 8/2014 | Blake et al. | 244/3.24 |
| 8,894,003 | B2 * | 11/2014 | Shai | 244/39 |
| 2003/0037665 | A1 * | 2/2003 | Rupert et al. | 89/1.8 |
| 2004/0011920 | A1 * | 1/2004 | Johnsson et al. | 244/3.29 |
| 2004/0144888 | A1 * | 7/2004 | Dryer et al. | 244/3.27 |
| 2004/0164202 | A1 * | 8/2004 | Klestadt et al. | 244/3.24 |
| 2005/0056723 | A1 * | 3/2005 | Clancy et al. | 244/3.24 |
| 2005/0236514 | A1 * | 10/2005 | Lawless | 244/3.27 |
| 2006/0065775 | A1 * | 3/2006 | Smith et al. | 244/3.23 |
| 2007/0018033 | A1 * | 1/2007 | Fanucci et al. | 244/3.27 |
| 2007/0045466 | A1 * | 3/2007 | Hellis | 244/3.29 |
| 2008/0061188 | A1 * | 3/2008 | Morris et al. | 244/3.23 |
| 2008/0237391 | A1 * | 10/2008 | Mock et al. | 244/3.1 |
| 2008/0302906 | A1 * | 12/2008 | Bar et al. | 244/3.22 |
| 2008/0315032 | A1 * | 12/2008 | Harnoy | 244/3.23 |
| 2009/0090809 | A1 * | 4/2009 | Ronn et al. | 244/3.28 |
| 2009/0272840 | A1 * | 11/2009 | Dietrich et al. | 244/16 |
| 2010/0001117 | A1 * | 1/2010 | Kusic | 244/3.1 |
| 2010/0175546 | A1 * | 7/2010 | Crawford et al. | 89/1.14 |
| 2010/0198514 | A1 * | 8/2010 | Miralles | 701/302 |
| 2010/0237185 | A1 * | 9/2010 | Dryer | 244/3.22 |
| 2010/0282895 | A1 * | 11/2010 | Geswender | 244/3.29 |
| 2010/0288870 | A1 * | 11/2010 | Geswender et al. | 244/3.27 |
| 2010/0320312 | A1 * | 12/2010 | Bril et al. | 244/3.16 |
| 2012/0018572 | A1 * | 1/2012 | Shai | 244/39 |
| 2012/0048993 | A1 * | 3/2012 | Velez | 244/3.28 |
| 2012/0068002 | A1 * | 3/2012 | Unger et al. | 244/3.28 |
| 2013/0041527 | A1 * | 2/2013 | Sowers et al. | 701/3 |
| 2014/0172200 | A1 * | 6/2014 | Miralles | 701/3 |

FOREIGN PATENT DOCUMENTS

| | | | |
|---|---|---|---|
| WO | WO-02/061363 | A2 | 8/2002 |
| WO | WO-2007/030687 | A2 | 3/2007 |
| WO | WO-2008/108869 | A2 | 9/2008 |
| WO | WO-2010/119442 | A1 | 10/2010 |

* cited by examiner

ROTATIONALLY STABILIZED GUIDABLE PROJECTILE AND METHOD FOR GUIDING THE SAME

CROSS REFERENCE TO RELATED APPLICATIONS

This application is a National Phase filing under 35 U.S.C. §371 of PCT/SE2012/000098 filed on Jun. 26, 2012; and this application claims priority to Application No. 1130064-7 filed in Sweden on Jul. 7, 2011; the entire contents of all are hereby incorporated by reference.

TECHNICAL FIELD

The present invention relates to a rotationally stabilized guidable projectile intended for launching from a barrel, comprising a front projectile part, a rear projectile part, and an intermediate projectile part comprising a rotatable middle section and guide wings. The invention also relates to a method for guiding the said rotationally stabilized projectile.

BACKGROUND OF THE INVENTION, PROBLEM DEFINITION AND PRIOR ART

The target precision for a projectile in an artillery system is governed largely by meteorological aspects and by how closely the actual launch velocity, V0, tallies with the calculated launch velocity, as well as by launcher-dependent factors, such as the configuration of the barrel and the exactness of the aiming system. Before guidable projectiles began to be used in artillery applications, there was no possibility of influencing the trajectory of the projectile after the projectile had left the barrel.

Through the introduction of guide elements, such as a rudder or fins/wings, the guidance capability of a projectile is able to be controlled. Depending on the configuration, placement and size of the fins/wings, different degrees of guidance capability can be achieved. Different guidance capabilities are required, depending on the VO, firing range, trajectory height and target precision of the projectile. For a short firing range and high target precision, guidance capability merely during the end phase of the projectile is sufficient, which means that smaller fins in the front part of the projectile can be used. In the case of a long firing range and high target precision, guidance capability is required during both the gliding phase and end phase of the projectile, which calls for larger fins/wings with high guidance dynamic.

Reliable techniques for calculating the current position of a projectile during its trajectory phase, based on inertial navigation and/or satellite navigation via GPS, have also been developed. For reliable use of satellite navigation techniques or navigation technology based on electromagnetic or optical communication with ground-based transmitters, stable communication between the satellite/the transmitter and the receiver antenna of the projectile is required. It is then advantageous if the receiver antenna is arranged such that it is roll-stable.

Rotationally stabilized projectiles in which the rear part, middle part or front part of the projectile is arranged so as to rotate freely relative to the rest of the projectile in order to stabilize the projectile, and in which the freely rotating part is arranged with guide fins in order to guide the projectile during its gliding and end phase, are previously known.

EP 1 299 688 B1 describes a roll-stabilized guidable projectile, the rear part of which is freely rotating relative to the rest of the projectile body. Guide fins, for guiding the projectile during the end phase, are disposed on the front part of the projectile, i.e. on the part which does not rotate.

US 2005/0056723 A1 describes a guidable rotationally stabilized projectile, the guide fins of which are fixedly disposed on the nose cone of the projectile, which nose cone is rotatably arranged relative to the rest of the projectile body. In a shown embodiment having four guide fins, two of the fins are positioned at an equal yet opposite angle in the axial direction of the fins, in the axis which is formed in the longitudinal direction of the fins radially outward from the projectile body, so that a propeller-like configuration is formed to counter the rotational force from the projectile. The other two fins are positioned at the same angle in the same direction in the axial direction of the fins, in the axis which is formed in the longitudinal direction of the fins radially outward from the projectile body. Once the rotation of the nose cone has been stabilized relative to the projectile body, the two horizontally positioned fins will generate a lifting force, which means that the projectile can be guided.

US 2008/0061188 A1 describes a rotationally stabilized projectile having a rotating middle section with fixedly mounted guide fins. The middle section is used for roll-stabilization and the fins for guidance of the projectile. Roll-stabilization of the middle section is realized purely by braking relative to the projectile body when the moment of inertia in the projectile body is large relative to the middle section.

One problem with the said projectile constructions, especially in the case of long firing ranges, is that the limited fin size results in low gliding capability.

A further problem with the said projectile constructions is that limited guidability sets in when the rotation of the rotationally stabilized projectile decreases in the case of long firing ranges.

Further problems which the invention aims to solve will emerge in connection with the following detailed description of the various embodiments.

OBJECT OF THE INVENTION AND ITS CHARACTERIZING FEATURES

One object of the present invention is a rotationally stabilized guidable projectile having improved guidance capability during the gliding and end phase of the projectile.

A further object of the present invention is an improved method for guiding the projectile during the gliding and end phase of the projectile.

According to the present invention, a rotationally stabilized projectile for launching from a barrel, having improved gliding capability and guidance capability during the gliding phase and end phase of the projectile, has thus been attained, which projectile comprises a front projectile part, a rear projectile part comprising a rotating band, and an intermediate projectile part comprising a freely rotatable middle section arranged with guide wings.

The projectile is characterized in that the guide wings are arranged extensibly on the freely rotatable middle section, and in that the intermediate projectile part also comprises a regulator device for regulating the rotation of the middle section.

According to further aspects of the invention:

the regulator device is of the electromagnetic type comprising permanent magnets coaxially arranged on the inner side of the rotatable middle section concentrically around an electrical winding disposed on the intermediate projectile part, wherein the number and sizes of the permanent magnets are chosen such that a rotation of the middle section induces a magnetic field in the electrical winding, so that an electric current is generated in an electrical resistance connected to the electrical winding, which manifests itself as a braking force upon the rotating middle section;

the regulator device is of the electromagnetic type comprising an electrical winding coaxially arranged on the inner side of the rotatable middle section concentrically around permanent magnets disposed on the intermediate projectile part, wherein the number and sizes of the permanent magnets are chosen such that a rotation of the middle section induces a magnetic field in the electrical winding, so that an electric current is generated in an electrical resistance connected to the electrical winding, which manifests itself as a braking force upon the rotating middle section;

the electrical winding can be variably loaded via the connection of different electrical resistances for generation of a variable brake force in the middle section;

the regulator device is of the electromagnetic type comprising permanent magnets coaxially arranged on the inner side of the rotatable middle section concentrically around an electrical winding disposed on the intermediate projectile part for the creation of variable rotational force on the middle section by virtue of the fact that the number and sizes of the permanent magnets are chosen for the creation of a static magnetic field oppositely directed to a variable magnetic field created by the electrical winding which has been variably energized from a separate electrical energy storage unit;

the regulator device is of the electromagnetic type comprising an electrical winding coaxially arranged on the inner side of the rotatable middle section concentrically around permanent magnets disposed on the intermediate projectile part for the creation of variable rotational force on the middle section by virtue of the fact that the number and sizes of the permanent magnets are chosen for the creation of a static magnetic field oppositely directed to a variable magnetic field created by the electrical winding which has been variably energized from a separate electrical energy storage unit;

the separate electrical energy storage unit is a chargeable capacitor;

the separate electrical energy storage unit is a chargeable battery;

the separate electrical energy storage unit is a fuel cell;

the middle section comprises two extensible guide wings oppositely placed relative to each other on either side of the projectile;

the middle section comprises four extensible guide wings evenly distributed around the projectile;

the middle section is rotatably mounted on the intermediate projectile part with slide bearings.

Furthermore, according to the present invention, an improved method for guiding a projectile during the gliding phase and end phase of the projectile has been attained, which projectile comprises a front projectile part, a rear projectile part comprising a rotating band, and an intermediate projectile part comprising a middle section rotatable relative to the projectile and arranged with guide wings.

The method is characterized in that the projectile is guided towards its target by extension of the guide wings and by virtue of the fact that the rotation of the rotatable middle section via a regulator device, in response to control signals from a control unit, is regulated to the correct position relative to the projectile.

According to further aspects of the method, according to the invention:

the rotation of the middle section is controlled electromagnetically by the regulator device by resistive loading of the electrical winding on the intermediate projectile part, via the connection of various electrical resistances;

the rotation of the middle section is controlled electromagnetically by the regulator device by energization of the electrical winding on the intermediate projectile part, via a separate electrical energy storage unit.

ADVANTAGES AND EFFECTS OF THE INVENTION

The invention solves the problem of low gliding capability and poor guidability by combining an actively rotatable middle section with extensible guide wings.

An actively rotatable middle section with extensible guide wings allows guide wings having a large aerodynamic surface and improved guidance dynamic, which means that the total firing range of the projectile can be increased, at the same time as the guidance capability of the projectile during gliding phase and end phase is improved.

The introduction of active positioning by braking or rotation of the rotatable middle section with the aid of a resistive load or energy storage unit connected to the electrical winding means improved guidance dynamic by virtue of the fact that the middle section and the guide fins can be rapidly positioned to the correct roll angle, including in the event of a long firing range.

LIST OF FIGURES

The invention will be described in greater detail below with reference to the appended figures, in which.

DETAILED DESCRIPTION OF EMBODIMENTS

Figure 1:
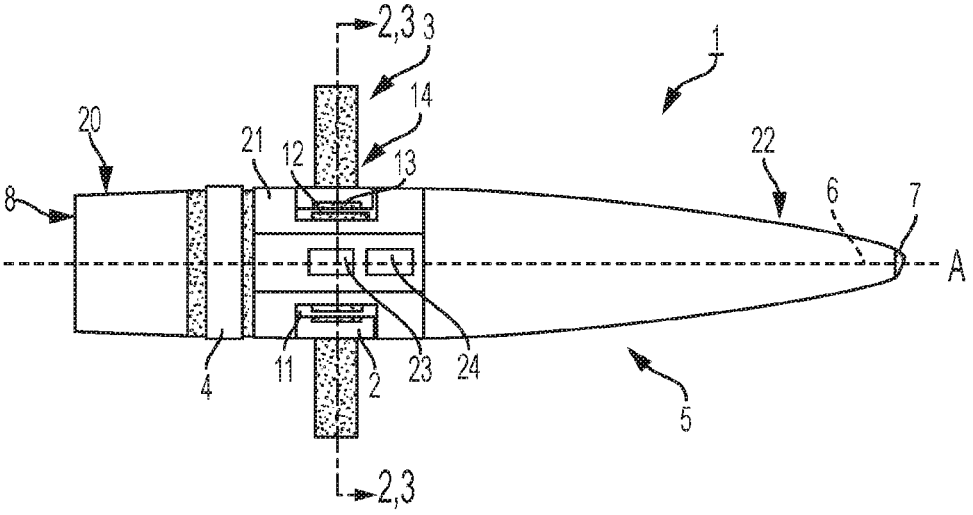
FIG. 1 shows a side view of a projectile having two extended guide wings and a partially visible guide mechanism according to the invention.
Figure 2:
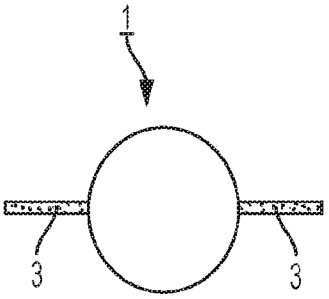
FIG. 2 shows a cross section through line 2,3 of a projectile according to FIG. 1, having two extended guide wings, positioned for gliding function, according to the invention.
Figure 3:
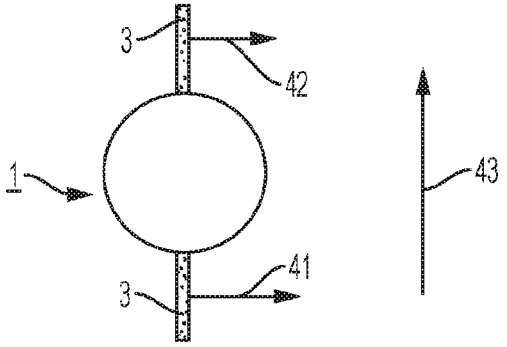
FIG. 3 shows a cross section through line 2,3 of a projectile according to FIG. 1, having two extended guide wings, positioned for guiding function, according to the invention.

FIG. 1 shows a preferred embodiment of a rotationally stabilized projectile 1, having a rotating middle section 2 provided with guide wings 3, which middle section 2 is regulated by a regulator device 14 for regulating the middle section 2 and thus guiding the projectile 1 towards a defined target, in which the said guidance is commenced in the trajectory following launch of the projectile from a barrel.

The projectile 1 is divided into three main parts: a rear projectile part 20 comprising a rotating band and a base flow charge, an intermediate projectile part 21 comprising a rotatable middle section 2 provided with guide wings 3, and a front projectile part 22 comprising a satellite navigation unit 6 and a homing device 7. The intermediate projectile part 21 comprises a rotatable middle section 2, which is disposed on the rear half of the projectile and in which the regulator device 14 of the projectile 1 is arranged. The middle section 2 comprises at least two extensible guide wings 3, which during the launch process are extended or retracted against the projectile body 5 so as to be extended radially from the projectile body 5 after the launch process. The projectile 1 is constituted by the projectile body 5 and the rotatable middle section 2, which latter is arranged with a movable coupling and is provided with guide wings 3 and permanent magnets 13. The guide wings 3 are, for example, retracted against the projectile body 5 and/or arranged in pretensioned construction with, for example, a spring mechanism, and can be locked with a locking ring. Other locking devices, too, are possible, such as shear pins or gluing, not shown in the figure.

The guide wings 3 have, mutually between one another, different angling in the axis which is formed in the longitudinal direction of the guide wings radially outwards from the projectile body 5. The different angling of the guide wings 3 means that a lifting as well as a rotating force upon the middle section 2 is created, which forces give both gliding and guidance capability. The guide wings are placed on that part of the projectile 1 in which the projectile 1 has the greatest diameter. That part of the projectile in which the diameter is virtually the same as the inner diameter of the barrel is also the maximum circumference of the projectile 1 and thus also provides the opportunity to construct guide wings of greatest fin length. The positioning of the guide wings is at or close to the centre of gravity of the projectile 1. The guide wings are placed in front of the rotating band 4 of the projectile 1, which protects the guide wings 3 from exposure to propellent gas generated by the propellent charge during the launch process.

The middle section 2 is arranged rotatably on the intermediate projectile part 21 via a movable coupling, which is preferably constituted by one or more ball or slide bearings 11 with low friction. The ball or slide bearings 11 are of standard type and are therefore not discussed in detail in the remainder of the description. The intermediate projectile part 21 also comprises a set of permanent magnets 13 concentrically arranged on the inner side of the middle section 2, and an electrical winding 12 concentrically arranged on the outer side of the intermediate projectile part 21, in which the permanent magnets 13 are enclosing the electrical winding 12 such that the permanent magnets 13, upon rotation of the middle section 2, induce a magnetic field in the electrical winding 12, whereby the rotation of the middle section 2 relative to the projectile 1 can be regulated. In an alternative embodiment, the winding 12 can be concentrically arranged on the inner side of the middle section 2, and permanent magnets can be concentrically arranged on the outer side of the intermediate projectile part 21.

In the preferred embodiment, FIG. 1, the electrical winding 12 is also arranged such that the magnetic resistance between the permanent magnets 13 and the electrical winding 12 can be regulated in level by a resistive load, via the connection of one or more electrical resistances. Through the resistive loading of the electrical winding 12, the rotation of the middle section 2 relative to the projectile 1 can therefore be controlled.

In an alternative embodiment, the projectile 1 also comprises an energy storage unit 23 for energizing the electrical winding 12 to allow rotation and thus positioning of the middle section 2, for example when the projectile 1 has finished rotating. The energy storage unit 23 is preferably of the chargeable type and is constituted by a chargeable capacitor or battery. Alternatively, the energy storage unit 23 is of the disposable type, for example a fuel cell or a pyrotechnic charge.

All in all, control elements are constituted by the middle section 2 provided with guide wings 3 and by a regulator device 14 comprising the permanent magnets 13 and the electrical winding 12. The regulator device 14 rotates the middle section 2 in relation to the intermediate projectile part 21 in order to guide the projectile 1. A control unit 24 gives control signals to the regulator device 14 based on the position of the projectile 1 and the target of the projectile, which is known information for the control unit 24.

Figure 4:
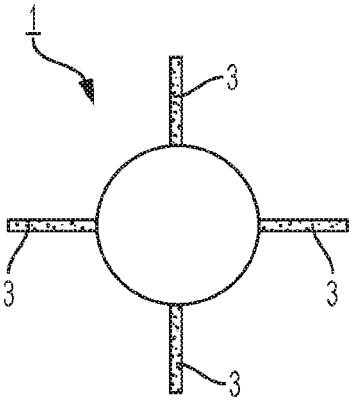
FIG. 4 shows a cross section through line 2,3 of a projectile according to FIG. 1, having four extended guide wings, positioned for guiding function, according to the invention.

In the following description of the projectile 1 and its guide wings 3, reference is made to FIGS. 1-4. A projectile 1 having extended guide wings 3, according to FIG. 2, acquires a longer firing range by virtue of the greater aerodynamic lifting force given by the larger guide wings 3 compared with that given by smaller, fixedly disposed guide fins. In the case of two guide wings 3, the angling of the guide wings 3 creates two different lifting forces 41 and 42. One guide wing 3 creates a lifting force 41 and the other guide wing 3 creates a lifting force 42, in which the lifting force 41 is greater than the lifting force 42. In order to manoeuvre the projectile 1 to the right in the direction of flight, the rotating middle section 2 and the guide wings 3 are positioned according to FIG. 3. The force vectors 41 and 42 cooperate to guide the projectile 1 to the right, viewed in the direction of travel, with, from the surface of the earth, vertical direction indicated by the vector 43. In the same way, not shown here, manoeuvring of the projectile 1 to the left, viewed in the direction of travel, can be achieved by positioning the guide wings at 180 degrees opposite to the position in FIG. 3.

Where the projectile 1 is configured with four guide wings 3, according to FIG. 4, two of the guide wings 3 will be configured with angling in the same direction and are essentially guide fins, and the two other guide wings 3 are essentially glide fins, preferably oppositely angled in order to achieve a propeller-like function. The guide wings 3 which are essentially glide fins can also be configured without angling so as to only provide lift. Where the guide wings 3 which are glide fins have propeller-shaped angling, then the angling is arranged to preferably be opposite to the rotational direction of the projectile in order to more rapidly roll-stabilize the rotating middle section 2, but can also be unidirectional with the rotational direction of the projectile.

The rotational direction of the projectile 1 is given by the inner rifling of the barrel. In the launch of the projectile 1, the rifling will take hold of the rotating band 4 and mechanically force the projectile 1 to rotate. The size of the rotational velocity is determined by the length of the barrel, the pitch of the rifling and by the launch velocity. An alternative for reducing or wholly preventing rotation after launch is to use a slipping rotating band.

Functional Description

When the projectile 1 is launched from a barrel, the projectile 1 leaves the mouth of the barrel rotationally stabilized or with a certain rotation, but not fully rotationally stabilized.

As a result of the rotating band 4, the guide wings 3 and the middle section 2 have been protected from gunpowder gases and gunpowder particles during the launch phase. At a suitable moment or distance, preferably close to the summit of trajectory of the projectile 1, when the projectile is at its highest point, the guide wings 3 are radially extended from the projectile 1. The rotating middle section 2 is braked, fully or partially, depending on the aerodynamic roll damping during the extension of the wings.

Before the wing extension takes place, the rotating middle section 2 is braked by a resistive load being connected to the electrical winding 12 mounted in the intermediate projectile part 21 and hereby creating an increased electromagnetic braking force between the electrical winding 12 and the permanent magnets 13 disposed on the rotating middle section 2. Alternatively, the middle section 2 can be braked by energization of the electrical winding 12 and thereupon creating force against the permanent magnets 13, energization being realized from an electrical energy storage unit 23, such as, for example, a battery, capacitor or fuel cell, incorporated in the projectile. Where the middle section is braked resistively, then the electrical winding 12 is energized and the energy created during braking can be used to charge the electrical energy storage unit 23. The electrical winding 12 can consist of one or more electrical windings.

Regardless of how the middle section is roll-damped, the rotation of the projectile body 5 will not be affected more than to a limited extent essentially by friction losses in the store 11. Through changes to a resistive load, not shown, coupled to an electrical winding 12, the inductive load in the said electrical winding 12 is affected by the magnetic field created by the permanent magnets 13. By changing the resistive load, the roll angle of the guide wings 3 can be altered and the projectile can thus be guided by regulating the middle section 2 with the regulator device 14.

For long firing ranges, the rotation of the projectile body 5 can come to decrease and the middle section 2 can thus actively need to be rotated around the intermediate projectile part 21, and thus the projectile body 5, in order to be positioned to guide the projectile 1. By energizing the electrical winding 12, the regulator device 14 can rotate the middle section 2 provided with guide wings around the projectile body 5, so that guidance of the projectile can proceed even when the rotation of the projectile body 5 has decreased. Energization of the electrical winding 12 is realized from the electrical energy storage unit 23.

In the preferred embodiment, the middle section 2 is rotated with the regulator device 14 by both braking and active rotation of the middle section 2. In an alternative embodiment, the middle section 2 is rotated with active rotation by means of the regulator device 14 after the wing extension has roll-damped the middle section 2. In this embodiment, no braking function is used, but only a function for actively rotating the middle section 2.

Based on the position of the projectile 1, the middle section 2 is rotated in order to guide the projectile 1 towards a target. The position is calculated on the basis of satellite navigation, preferably GPS 6, and/or with inertial navigation. Close to the target, in the end phase of the projectile, guidance can be realized on the basis of information from the homing device 7. Depending on the extent to which the trajectory of the projectile 1 needs to be changed, the regulator device 14 positions the middle section 2, and thus the guide wings 3, for guidance in time periods, also referred to as guide periods. Between the guide periods, the guide wings 3 are kept horizontally positioned in order to increase the lift, and thus the firing range, of the projectile. Monitoring and controlling of how the regulator device 14 regulates the middle section 2 around the projectile body 5 is realized by a control unit 24 mounted in the projectile. The control unit 24 provides information to the regulator device 14, which comprises the permanent magnets 13 and the electrical winding 12. The said regulator device 14 rotates the middle section 2, and thus the guide wings 3, into the correct position on the basis of the position calculated by the control unit 24 or otherwise determined.

The position of the middle section 2 relative to the intermediate projectile part 21, and thus the projectile body 5, is read off and fed back to the control unit 24 with sensors of, for example, optical, electrical or mechanical construction. The homing device 7 is used to guide the projectile 1 in the end phase when the projectile 1 is approaching the target.

Signals from the homing device 7 will in this case act upon the control unit 24, and thus the regulator device 14, in order to guide the projectile 1 towards the target.

Illustrative Embodiment

One example of a rotationally stabilized projectile is an artillery shell having an outer diameter of 155 mm and having a projectile length in the order of magnitude of 30-80 cm, comprising two extensible guide wings mounted opposite each other on a section which rotates freely from the profile, in which one guide fin is twisted by 10 degrees and the other by 11 degrees in order to jointly create essentially a lifting force having a somewhat torsional force when the wings are in the horizontal plane.

Alternative Embodiments

The invention is not limited to the shown embodiments but can be varied in different ways within the scope of the invention.

It will be appreciated, for example, that the number, size, material and shape of the elements and components which make up the projectile are adapted to the weapon system or systems and other design features which are relevant at that time.

It will be appreciated that the above-described projectile can embrace many different dimensions and projectile types depending on the field of application and the barrel width. In the above, however, reference is made to at least the currently most common ammunition types having a diameter between about 25 mm and 200 mm.

The guiding method can also be used to launch projectiles from a smooth-bore barrel, such as, for example, a bazooka. Once the projectile is roll-stable, the middle section is rotated, with the extended wings, into the desired position for guidance of the projectile.

The invention claimed is:

1. A rotationally stabilized projectile which is to be launched from a barrel, and wherein said projectile comprises a front projectile part, a rear projectile part-comprising a rotating band, and an intermediate projectile part comprising a freely rotatable middle section arranged with at least two radially extendable guide wings, wherein the guide wings are arranged extensibly on the freely rotatable middle section and are located in front of the rotating band, and wherein the intermediate projectile part also comprises a regulator device for regulating the rotation of the middle section.

2. The projectile according to claim 1, wherein the regulator device is of the electromagnetic type comprising permanent magnets coaxially arranged on the inner side of the rotatable middle section concentrically around an electrical winding disposed on the intermediate projectile part, wherein the number and sizes of the permanent magnets are chosen such that a rotation of the middle section induce a magnetic field in the electrical winding, so that an electric current is generated in an electrical resistance connected to the electrical winding, which electric current manifests as a braking force upon the rotating middle section.

3. The projectile according to claim 1, wherein the regulator device is of the electromagnetic type comprising an electrical winding coaxially arranged on the inner side of the rotatable middle section concentrically around permanent magnets disposed on the intermediate projectile part, wherein the number and sizes of the permanent magnets are chosen such that a rotation of the middle section induce a magnetic field in the electrical winding, so that an electric current is generated in an electrical resistance connected to the electrical winding, which electric current manifests as a braking force upon the rotating middle section.

4. The projectile according to claim 2, wherein the electrical winding will be variably loaded via the connection of different electrical resistances for generation of a variable brake force in the middle section.

5. The projectile according to claim 1, wherein the regulator device is of the electromagnetic type comprising permanent magnets coaxially arranged on the inner side of the rotatable middle section concentrically around an electrical winding disposed on the intermediate projectile part for the creation of variable rotational force on the middle section by virtue of the fact that the number and sizes of the permanent magnets are chosen such that a static magnetic field oppositely directed to a variable magnetic field created by the electrical winding which has been variably energized from a separate electrical energy storage unit.

6. The projectile according to claim 1, wherein the regulator device is of the electromagnetic type comprising an electrical winding coaxially arranged on the inner side of the rotatable middle section concentrically around permanent magnets disposed on the intermediate projectile part for the creation of variable rotational force on the middle section by virtue of the fact that the number and sizes of the permanent magnets-are chosen for the creation of a static magnetic field oppositely directed to a variable magnetic field created by the electrical winding which has been variably energized from a separate electrical energy storage unit.

7. The projectile according to claim 5, wherein the separate electrical energy storage unit is a chargeable capacitor.

8. The projectile according to claim 5, wherein the separate electrical energy storage unit is a chargeable battery.

9. The projectile according to claim 5, wherein the separate electrical energy storage unit is a fuel cell.

10. The projectile according to claim 1, wherein the middle section comprises two extensible guide wings oppositely placed relative to each other on either side of the projectile.

11. The projectile according to claim 1, wherein the middle section comprises four extensible guide wings evenly distributed around the projectile.

12. The projectile according to claim 1, wherein the middle section is rotatably mounted on the intermediate projectile part with slide bearings.

13. A method for guiding a projectile during the gliding and end phase of the projectile, which projectile comprises a front projectile part, a rear projectile part comprising a rotating band, and an intermediate projectile part comprising a middle section rotatable relative to the projectile and arranged with at least two radially extendable guide wings, wherein the guide wings are located in front of a rotating band, and wherein the projectile is guided towards a projectile target by extension of the guide wings and by virtue of the fact that the rotation of the rotatable middle section via a regulator device, in response to control signals from a control unit, is regulated to the correct position relative to the projectile.

14. The method according to claim 13, wherein the rotation of the middle section is controlled electromagnetically by the regulator device by resistive loading of the electrical winding on the intermediate projectile part, via the connection of various electrical resistances.

15. The method according to claim 13, wherein the rotation of the middle section is controlled electromagnetically by the regulator device by energization of the electrical winding on the intermediate projectile part, via a separate electrical energy storage unit.

16. The projectile according claim 3, wherein the electrical winding will be variably loaded via the connection of different electrical resistances for generation of a variable brake force in the middle section.

17. The projectile according to claim 6, wherein the separate electrical energy storage unit is a chargeable capacitor.

18. The projectile according to claim 6, wherein the separate electrical energy storage unit is a chargeable battery.

19. The projectile according to claim 5, wherein the separate electrical energy storage unit-is a fuel cell.

20. The projectile according to claim 2, wherein the middle section comprises two extensible guide wings oppositely placed relative to each other on either side of the projectile.

* * * * *